US007712862B1

(12) United States Patent
Campillo et al.

(10) Patent No.: US 7,712,862 B1
(45) Date of Patent: May 11, 2010

(54) INK STALAGMITE DETECTION

(75) Inventors: Alejandro Campillo, San Diego, CA (US); Justin Davison, San Diego, CA (US); Brian D Gragg, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/393,222

(22) Filed: Feb. 26, 2009

(51) Int. Cl.
*B41J 29/393* (2006.01)
*B41J 2/165* (2006.01)

(52) U.S. Cl. ..... 347/19; 347/23; 347/35

(58) Field of Classification Search ..... 347/35–36, 347/81

See application file for complete search history.

(56) References Cited

U.S. PATENT DOCUMENTS

| | | | | |
|---|---|---|---|---|
| 6,322,196 | B1 * | 11/2001 | Lim | 347/35 |
| 6,644,778 | B2 | 11/2003 | Rotering | |
| 6,742,864 | B2 | 6/2004 | Therien et al. | |
| 6,761,429 | B2 | 7/2004 | Su | |
| 7,384,123 | B2 | 6/2008 | Kawatoko et al. | |

* cited by examiner

*Primary Examiner*—Matthew Luu
*Assistant Examiner*—Lisa M Solomon

(57) ABSTRACT

Printer ink-drop detectors are used to detect ink stalagmites forming on a waste ink receiving spittoon. A warning message can be issued so that the stalagmites can be removed before automatic printer shutdown is initiated. Additionally, a record of the ink stalagmite detection can be stored within the printer for later access by service personnel during routine maintenance and/or resource replenishment.

15 Claims, 4 Drawing Sheets

INK STALAGMITE DETECTION

BACKGROUND

Ink jet printing devices and processes use a multitude of controlled ink discharge nozzles in order to form images on print media. In some devices, automated testing procedures are performed to determine which, if any, of the ink discharge nozzles are failing to operate properly. Such testing procedures are referred to as "drop detection". Subsequent printing operations can be automatically modified, if needed, in the interest of mage quality once any failed nozzles are identified.

Waste ink is generated during each drop detection procedure. Over the course of numerous such tests, waste ink can accumulate and harden in the form of "stalagmites". Such stalagmites are typically supported by a waste ink receptacle (i.e., spittoon) and can grow until they interfere with the operation of the drop detection sensors (i.e., drop detectors). Such interference with the drop detectors can lead to false interpretation of massive nozzle failures, automatically rendering the ink jet printing device inoperative until serviced by personnel.

Accordingly, the embodiments described hereinafter were developed in the interest of addressing the foregoing problems.

BRIEF DESCRIPTION OF THE DRAWINGS

The present embodiments will now be described, by way of example, with reference to the accompanying drawings, in which.

DETAILED DESCRIPTION

Introduction

Means and methods for detecting stalagmites formed of waste ink media are provided by the present teachings. A spittoon of an ink jetting printer is shifted toward one or more drop detectors. Light-beam and/or other detection means of the drop detectors sense the presence of any ink stalagmites that are supported on the spittoon. A warning message indicative of stalagmite detection is generated and dispatched. Additionally, or in the alternative, a record of the stalagmite detection event is recorded within computer-accessible storage media of the printer for later recall. Such detection typically allows sufficient lead time to remove the stalagmite(s) during routine servicing and before automated shutdown of the printer is performed.

In one embodiment, an apparatus includes a drop detector that is configured to detect an emission of an ink media from one or more of ink jetting devices. The apparatus also includes a spittoon configured to receive ink media emitted from the one or more ink jetting devices. The drop detector is also configured to provide a detection signal in response to detecting at least one ink media stalagmite supported by the spittoon.

In another embodiment, a method includes shifting a spittoon toward a drop detector. The method also includes detecting at least one ink stalagmite supported by the spittoon using the drop detector. The detecting is performed while the spittoon is shifted toward the drop detector. The at least one stalagmite includes waste ink media. The method additionally includes issuing a signal indicative of detecting the at least one ink stalagmite from the drop detector.

In yet another embodiment, a controller for an ink jetting printer is provided. The controller is configured to issue a command signal to cause a spittoon to be shifted toward a drop detector. The controller is also configured to receive a detection signal from the drop detector indicative of one or more ink stalagmites supported by the spittoon. The controller is further configured to issue a warning message in response to the receiving the detection signal.

First Illustrative Embodiment

Figure 1:
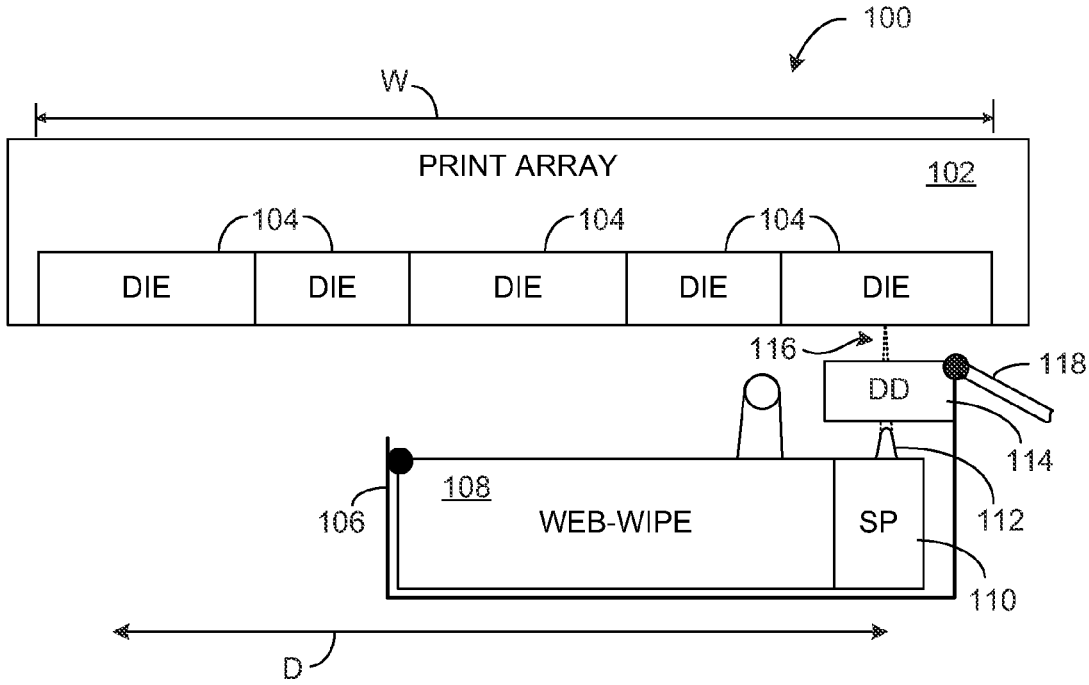
FIG. 1 depicts a block diagrammatic view of select portions of a printing apparatus according to one embodiment.

FIG. 1 depicts a block diagrammatic view of select portions of a printing apparatus (printer) 100 according to one embodiment. The printer 100 is illustrative and non-limiting in nature. Thus, other printers can be defined, configured and used in accordance with the present teachings.

The printer 100 includes a page-wide print array 102. The print array 102 includes a plurality of dies 104. The dies 104 are arranged in staggered, partially overlapping adjacency with one another such that a continuous printable width "W" is defined by the array 102. Each die 104 includes a plurality of ink discharge nozzles (not shown) configured to discharge liquid ink so as to form images on print media (not shown) in response to corresponding control signaling. One having ordinary skill in the printing and related arts can appreciate the typical characteristics and operations involved in ink jet printing, and further elaboration of the print array 102 is not required for purposes of understanding the present teachings.

The printer 100 also includes a service station 106. The service station 106 is configured and equipped so as to be moved (translated) from a location away from the print array 102 along a path beneath the print array 102. The bidirectional arrow labeled "D" indicates the translational nature of the service station 106. In this way, the service station 106 can perform drop detection testing and nozzle cleaning of the print array 102. Further description of typical service station 106 operations is provided hereinafter.

The service station 106 includes a web-wipe assembly 108. The web-wipe assembly 108 is configured to make wiping, cleaning contact with the print array 102 so as to remove residual ink, media dust and/or other debris there from. The service station 106 also includes a spittoon (waste ink receptacle) 110. The spittoon 110 typically, but not necessarily, includes a sponge or foam-like material configured to receive waste ink that is produced during drop detection procedures. As shown, an illustrative stalagmite 112, comprised of waste ink, has formed upon and is supported by the spittoon 110.

The service station 106 of the printer 100 also includes one or more drop detectors 114. Only one drop detector 114 is depicted in FIG. 1 for simplicity. Each drop detector 114 is configured to detect the emission of ink 116 from one or more nozzles of the dies 104 of the print array 102 during drop detection operations. In one embodiment, each drop detector 114 is configured to detect the emission of ink 116 by way of a light beam emitter and corresponding light sensor (i.e., emitter and sensor pair). Other embodiments having other detection means/schemes can also be used. The service station 106 further includes a print array cover 118 that can be selectively rotated toward and away from the print array 102 so to provide a protective capping of the dies 104 when printing operation are not being performed.

Typical drop detection operations are performed as follows: the service station 106 is moved into position generally beneath one end of the print array 102. Ink discharge nozzles are controllably operated (i.e., "fired") one at a time while the corresponding drop detector(s) 114 is/are located in detection proximity there to. Ink discharge detection signals are provided accordingly by the drop detector(s) 114. The service station 106 is translated beneath the print array 102 while the ink discharge nozzles are individually and progressively test fired, until all of the nozzles of the print array 102 have been tested by way of the drop detector(s) 114. The resulting detection signals (or lack thereof) are used to identify which, if any, ink discharge nozzles faded to operate and subsequent printing operations are controlled accordingly.

Figure 2:
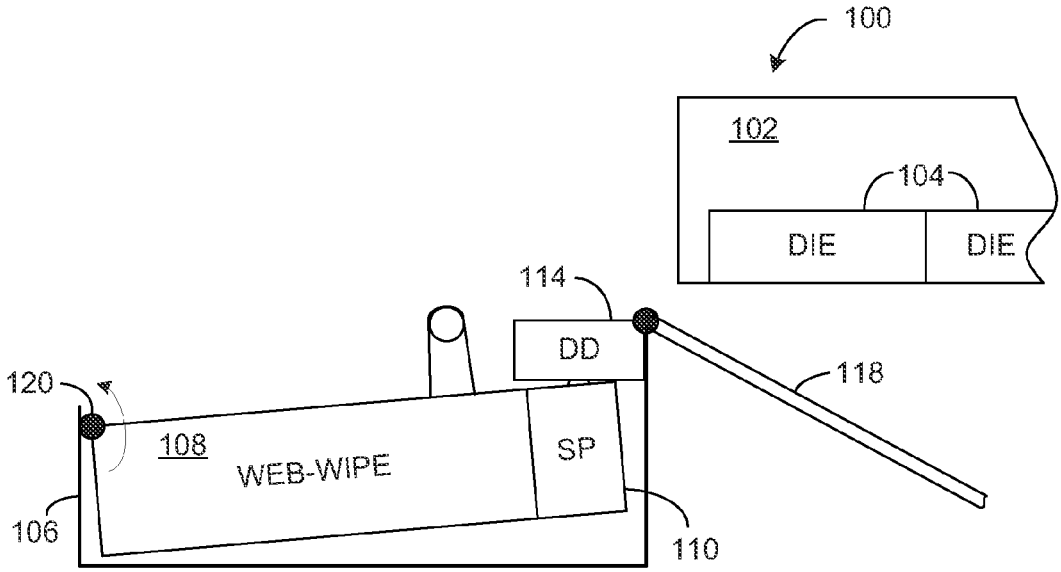
FIG. 2 depicts a block diagrammatic view of select portions of the printing apparatus of FIG. 1.

FIG. 2 depicts a block diagrammatic view of select portions of the printer 100 introduced above. As depicted, the service station 106 is located away from the print array 102. The web-wipe assembly 108 has been rotated about an axis 120 so as to shift (i.e., elevate) the spittoon 110 toward the one or more drop detectors 114. In this way, the illustrative stalagmite 112 is also shifted closer to the detection beam (or other means) of one of the drop detectors 114. If the stalagmite 112 is of sufficient size (i.e., height), then the corresponding drop detector 114 will detect the stalagmite 112 and provide a corresponding signal. Further elaboration regarding stalagmite detection and signal procedures according to the present teachings is provided hereinafter.

Figure 3:
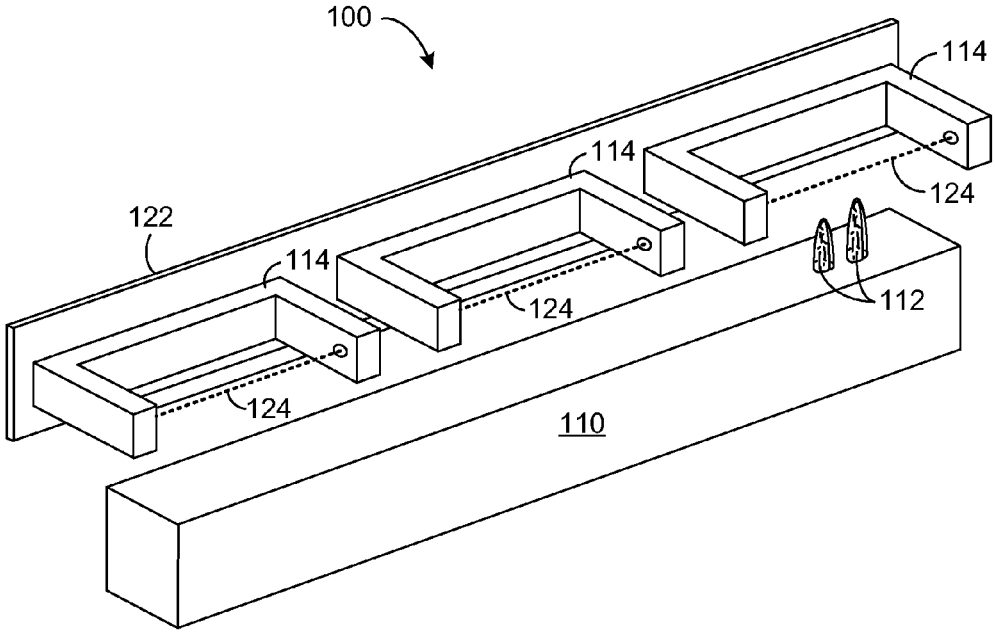
FIG. 3 depicts a diagrammatic perspective view of the printing apparatus of FIG. 1 according to one operating state.

FIG. 3 a block diagrammatic view of select portions of the illustrative and non-limiting printer 100 as introduced above. The printer 100 includes three drop detectors 114 supported by a circuit card 122. Each drop detector 114 is configured to detect ink emissions by way of a light beam 124. It is to be noted that each light beam 124 can be defined by an emission in the visible, infrared or ultraviolet range of the electromagnetic spectrum. The spittoon 110, as introduced above, is shown as a generally elongated block of sponge-like material located in spaced adjacency to the drop detectors 114. Such spaced adjacency (i.e., generally apart or away from) is typical during drop detection procedures so that waste ink (overspray) is collected by the spittoon 110. The spittoon 110 supports two illustrative stalagmites (also referred to as ink stalagmites or waste ink stalagmites) 112 that have progressively formed on the spittoon 110 as a result of successive drop detection testing.

Figure 4:
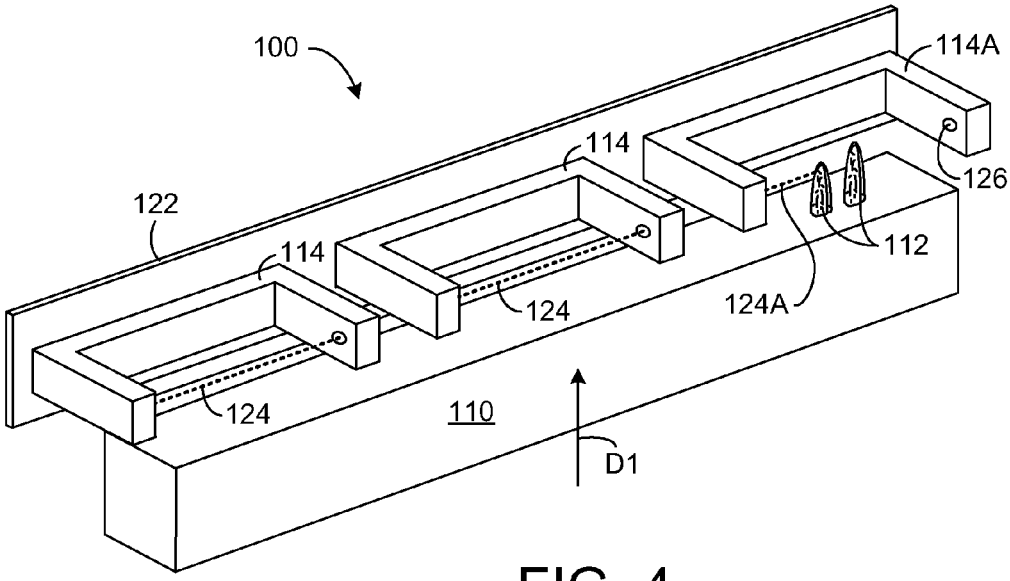
FIG. 4 depicts a diagrammatic perspective view of the printing apparatus of FIG. 1 according to another operating state.

FIG. 4 a block diagrammatic view of select portions of the illustrative and non-limiting printer 100 as introduced above and as further described with respect to FIG. 3. As shown in FIG. 4, the spittoon 110 as been shifted toward (i.e., proximate to) the drop detectors 114 as indicated by the arrow "D1". The shifting of the spittoon 110 results in at least one of the illustrative stalagmites 112 preventing the light beam 124A from reaching the sensor 126 of the drop detector 114A. The drop detector 114A will provide a corresponding signal indicative of the stalagmite 112 detection.

It is noted that the spittoon 110 is assumed to be shifted by way of angular motion of the supporting web-wipe assembly (see FIG. 2). In another embodiment, other means can be used to positionally shift the spittoon 110 relative to the drop detectors 114. In another non-limiting and illustrative embodiment, the spittoon is essentially stationary with respect to some supporting structure and the drop detector(s) is/are moved relative thereto. Once the stalagmite detection and signaling process is complete, the spittoon 110 and the drop detectors 114 are returned to the spaced adjacency shown in FIG. 3.

Second Illustrative Embodiment

Figure 5:
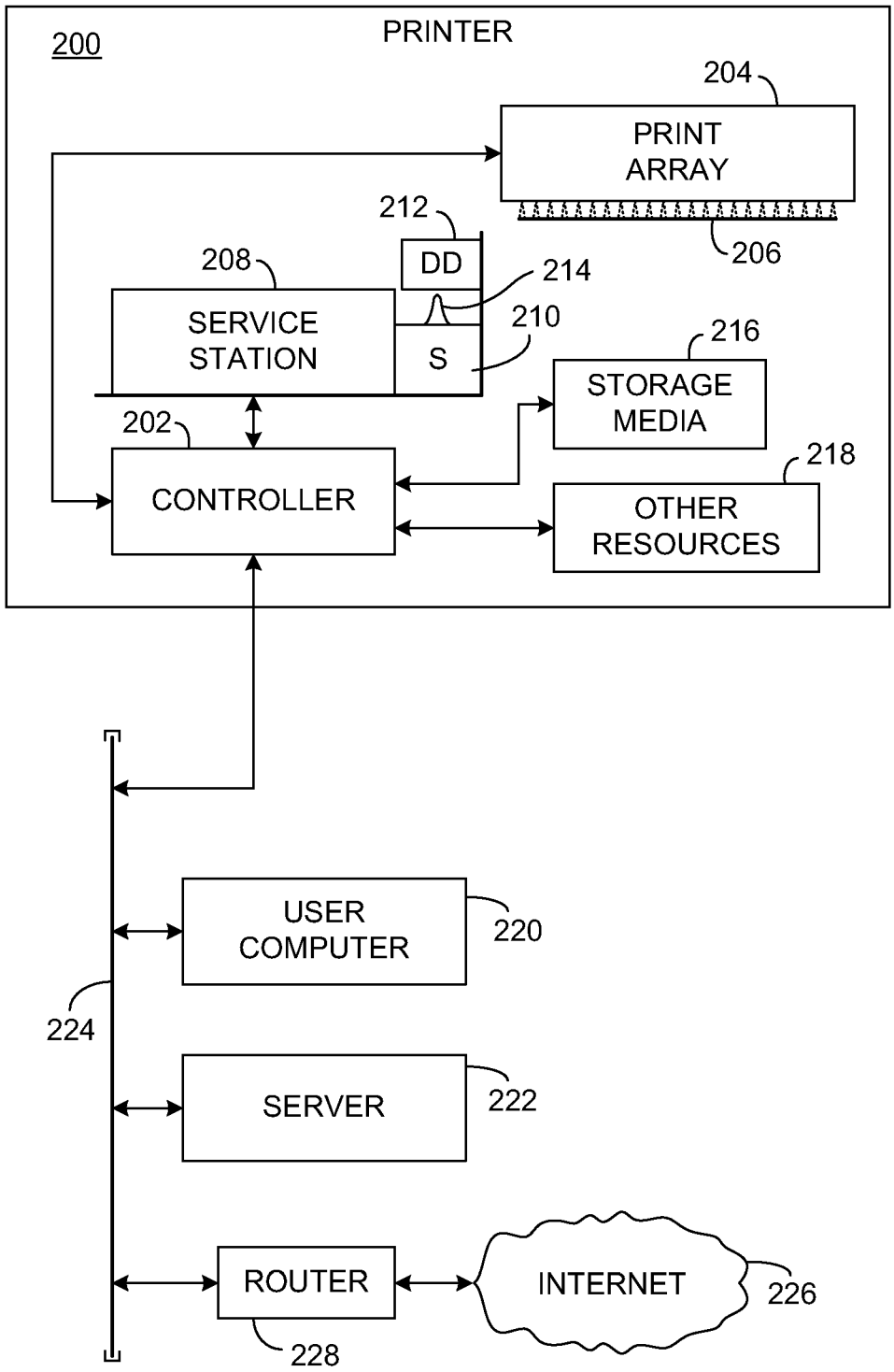
FIG. 5 depicts a block schematic view of a network printer according to another embodiment.

Reference is now made to FIG. 5, which depicts at network printer 200 according to another embodiment of the present teachings. The printer 200 is illustrative and non-limiting in nature. Thus, other printers can be defined, configured and used in accordance with the present teachings.

The printer 200 includes a controller 202. The controller 202 is configured to control various normal operations of the printer 200. As such, the controller 202 can include and/or be defined by one or more microprocessors or microcontrollers, one or more application-specific integrated circuits (ASICs), a state machine, digital circuitry, analog circuitry, etc. Other means can be used to define the controller 202. For purposes of non-limiting example, it is assumed that the controller 202 includes at least one microprocessor configured to control operations of the printer 200 in accordance with a program code. The controller 202 is connected in control signal and/or data communication with various other means and resources of the printer 200.

The printer 200 also includes a print array 204. The print array 204 includes numerous, individually controlled ink discharge nozzles configured to form images on media 206. The print array 204 is understood to be a page-wide print array. The print array 204 is coupled so as to be controlled by the controller 202.

The printer 200 also includes a service station 208. The service station 208 includes a spittoon 210 and at least one drop detector 212. As depicted, an ink stalagmite 214 has formed on and is supported by the spittoon 210. The service station 208 is configured to perform various operations including, for non-limiting example, drop detection during testing of the print array 204.

The printer 200 also includes storage media 216. The storage media 216 can be defined by any one or more tangible, computer-readable (i.e., readable and/or writable) storage media. Non-limiting examples of storage media 216 include optical storage media, magnetic storage media, solid-state memory, non-volatile solid-state memory, etc., alone or in any suitable combination. Other forms of storage media 216 can also be used. The storage media 216 is configured to provide one or more program code segments to controller 202. The storage media 216 is also configured to store information recorded by the controller 202.

The printer 200 further includes other resources 218. Such other resources 218 can include any means as desired or required to support normal printer operations. Non-limiting examples of other resources 218 include a power supplies, print media transport mechanisms, a print media dryer, an operator interface, communication input/output circuitry, wireless communication resources, post-imaging media treatment devices, one or more reservoirs of color ink media, etc. One having ordinary skill in the printing arts can appreciate that the printer 200 can include various means and resources typical to inkjet imaging operations, and that an exhaustive description is not needed for purposes of understanding the present teachings.

FIG. 5 further depicts additional illustrative and non-limiting network resources. Specifically depicted are a user computer 220 and a server 222 coupled in communication with each other and the printer 200 by way of a local area network (LAN) 224. The local area network 224 is also coupled in communication with the Internet 226 by way of a router 228. Illustrative operations of the printer 200 are described hereinafter.

First Illustrative Method

Figure 6:
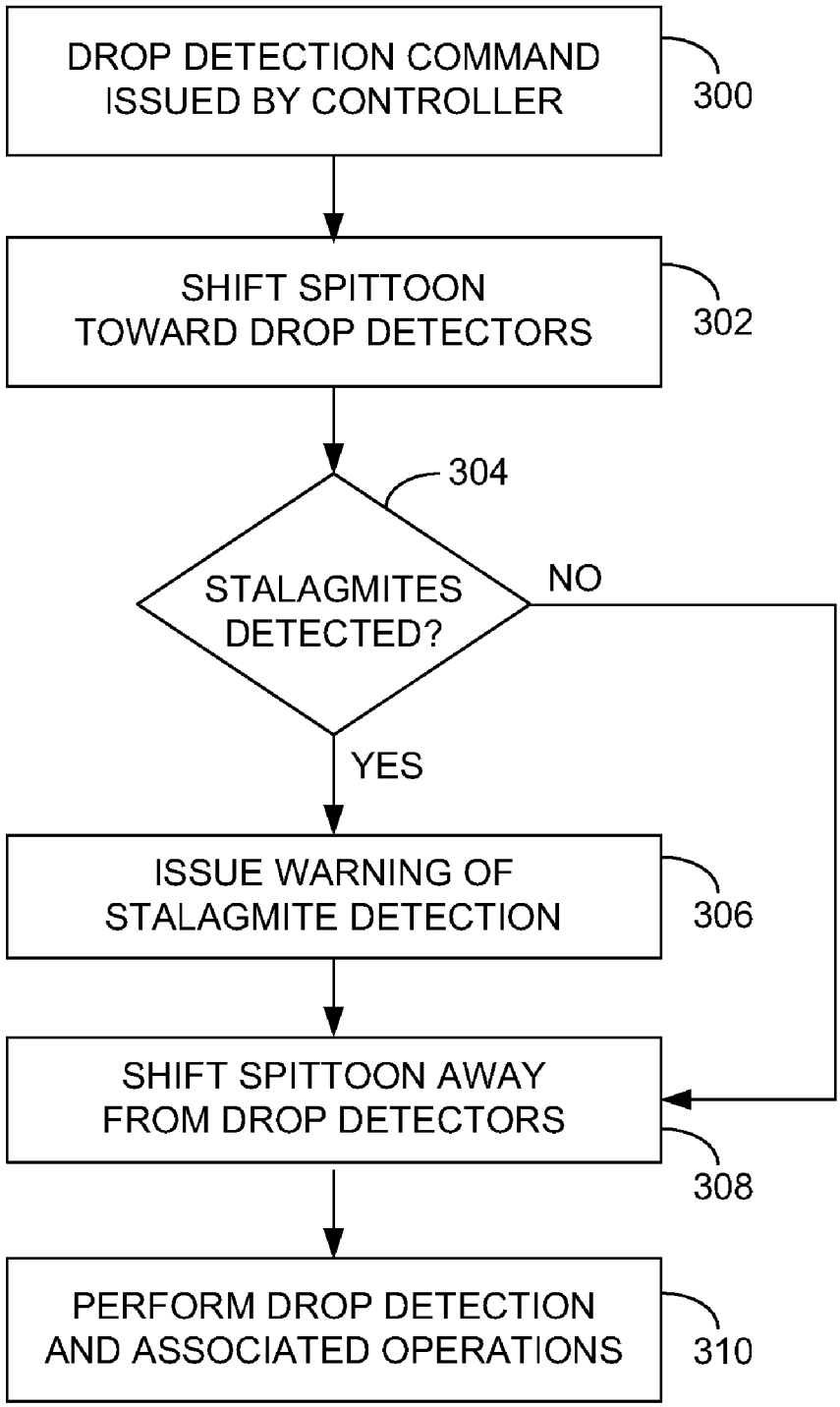
FIG. 6 depicts a flow diagram of a method according to still another embodiment.

FIG. 6 is a flow diagram depicting a method according to one embodiment of the invention. The method of FIG. 6 includes particular operations and order of execution. However, other methods including other operations, omitting one or more of the depicted operations, and/or proceeding in other orders of execution can also be used according to the present teachings. Thus, the method of FIG. 6 is illustrative and non-limiting in nature. The method of FIG. 6 is described with reference to FIG. 5 in the interest of understanding the present teachings.

At 300, a controller of an ink jetting (i.e., inkjet) printer issues a drop detection command to a service station and/or other resources there of. For purposes of non-limiting example, it is assumed that the controller 202 provides one or more signals that cause the service station 208 to perform a drop detection sequence.

At 302, a waste ink receiving spittoon of the ink jetting printer is shifted toward one or more drop detectors of the printer. For purposes of the ongoing example, the service station 208 shifts the spittoon 210 toward the drop detector 212.

At 304, the one or more drop detectors are used to detect the presence of any waste ink stalagmites supported by the spittoon. If no stalagmites are detected, then the method proceeds on 308 below. If one or more stalagmites are detected by the drop detector(s), then the method proceeds to 306 below. For purposes of the ongoing example, it is assumed that the drop detector 212 detects the stalagmite 214 and sends a corresponding detection signal to the controller 202. Under this example, the method proceeds to 306 below.

At 306, a warning message is issued indicative of the stalagmite detection at 304 above. Such a message can be provided locally at the printer by way of a user interface, can include a message transmitted to a user by way of a network, and/or by way of other messaging schemes. The message and/or related data (e.g., detection time and date, specific drop detector(s) sensing the stalagmite, etc.) can also be recorded on computer-accessible storage media for later access. For purposes of the ongoing example, it is assumed that the controller 202 issues a warning message to a remote recipient by way of the Internet 226, and records the stalagmite detection event on the storage media 216.

At 308, the spittoon is shifted away from the one or more drop detectors of the printer. For purposes of the ongoing example, it is assumed that the service station 208 shifts the spittoon 210 away from the drop detector 212. The spittoon 210 is now in position to receive waste ink media during normal drop detection operations.

At 310, the drop detection procedure continues as defined for the printer. Such procedure typically includes sequentially test firing each of the ink jetting nozzles while the corresponding drop detector(s) are in sensing proximity thereto. The overall results of the drop detection testing are then automatically analyzed and subsequent printing operations are controlled accordingly. For purposes of the ongoing example, it is assumed that once the drop detection sequence is completed, the service station 208 moves away from the print array 204 and normal printing operations can then be performed.

The foregoing method is illustrative of any number of methods contemplated by the present teachings, wherein detection of one or more stalagmites is used to trigger issuance of a warning message to a user. The appropriate service personnel or a skilled user can then address the matter by removing the stalagmites from the supporting spittoon. In this way, normal operations of the corresponding printer can be performed without interruption due to false nozzle failure interpretation caused by stalagmite growth into the drop detection zone.

In one embodiment, the automated stalagmite detection taught herein provides approximately three to four weeks of advance warning before false perception of massive nozzle outages causes automatic printer shutdown. Other advance lead times can also be achieved. Such advance warning can allow for removal of the stalagmites during a routine and otherwise necessary maintenance call for replenishment of printer consumables (e.g., paper media, ink media, etc.). Furthermore, access to stalagmite detection records kept within the storage media of the printer can alert a service technician or other user to the need to remove ink stalagmites before automated printer shutdown is performed.

In general, the foregoing description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. An apparatus, comprising:

a drop detector; and a spittoon configured to be shifted between a first position away from the drop detector and a second position proximate the drop detector, the drop detector configured to provide a detection signal responsive to detecting at least one ink stalagmite supported by the spittoon while the spittoon is in the second position, the at least one ink stalagmite being undetectable by the drop detector while the spittoon is in the first position.

2. The apparatus according to claim 1, the drop detector and the spittoon being portions of a service station, the service station configured to shift the spittoon between the first and second positions responsive to a control signal.

3. The apparatus according to claim 1, the drop detector further configured to detect an emission of ink from one or more ink jetting devices of the apparatus while the spittoon is in the first position.

4. The apparatus according to claim 1, the drop detector configured to detect the at least one ink stalagmite supported by the spittoon by way of a light beam emitter and a light sensor.

5. The apparatus according to claim 1 further comprising a page-wide print array including one or more ink jetting devices.

6. The apparatus according to claim 1 further comprising a controller configured to:

issue a control signal to cause the spittoon to be shifted from the first position to the second position;

receive the detection signal from the drop detector; and issue a warning message in response to receiving the detection signal.

7. The apparatus according to claim 1, the apparatus defined by an ink jet printer.

8. A method, comprising:

spacing a spittoon and a drop detector proximate each other;

detecting at least one ink stalagmite supported by the spittoon using the drop detector while the spittoon and the drop detector are proximate each other, the at least one ink stalagmite being too small to be detected by the drop detector when the spittoon and the drop detector are not proximate each other; and issuing a signal indicative of detecting the at least one ink stalagmite from the drop detector.

9. The method according to claim 8 further comprising spacing the spittoon and the drop detector away from each other after the detecting.

10. The method according to claim 8 further comprising issuing a warning message in response to the signal.

11. The method according to claim 8 further comprising recording information corresponding to the detecting on a computer-readable storage media.

12. A controller for an ink jetting printer, the controller configured to:

issue a command signal to cause a spittoon and a drop detector to be positioned proximate to each other;

receive a stalagmite detection signal from the drop detector indicative of one or more ink stalagmites supported by the spittoon, the one or more ink stalagmites being undetectable by the drop detector when the spittoon and the drop detector are positioned away from each other; and issue a warning message in response to the receiving the detection signal.

13. The controller according to claim 12, the controller including at least one processor configured to operate in accordance with a program code, the program code included on one or more computer-readable storage media.

14. The controller according to claim 12, the controller further configured to create a record within a computer-readable storage media, the record including data corresponding to the stalagmite detection signal.

15. The controller according to claim 12, the controller further configured to issue a command signal causing the spittoon and the drop detector to be positioned away from each other.

* * * * *